United States Patent [19]

Bakermans et al.

[11] Patent Number: 4,819,476

[45] Date of Patent: Apr. 11, 1989

[54] TOOLING FOR FORMING MACHINES HAVING IMPROVED GUIDANCE, TOOL MOUNTING, AND PILOT PIN SYSTEMS

[75] Inventors: Johannes C. W. Bakermans, Harrisburg; Dimitry G. Grabbe, Middletown, both of Pa.

[73] Assignee: AMP Incorporated, Harrisburg, Pa.

[21] Appl. No.: 74,656

[22] Filed: Jul. 17, 1987

[51] Int. Cl.[4] ..... B21D 37/12

[52] U.S. Cl. ..... 72/456; 72/450; 72/452; 72/427; 72/344; 72/351; 72/407; 83/623; 83/687

[58] Field of Search ..... 83/620, 623, 133, 134, 83/140, 687; 72/450, 405, 315, 452, 427, 344, 351, 456, 407, 402, 403; 29/1.21, 1.22

[56] References Cited

U.S. PATENT DOCUMENTS

| | | | |
|---|---|---|---|
| 2,078,706 | 4/1937 | Boker | 164/59 |
| 2,736,379 | 2/1956 | Winn et al. | 83/623 |
| 3,587,502 | 6/1971 | Murray | 113/1 |
| 3,640,167 | 2/1972 | Axtmann | 83/623 |
| 3,650,232 | 3/1972 | Heinlen . | |
| 3,919,909 | 11/1975 | Scott | 83/530 |
| 4,211,099 | 7/1980 | McGonigal | 72/47 |
| 4,257,300 | 3/1981 | Muzik | 83/687 |
| 4,489,871 | 12/1984 | Bakermans et al. | 226/52 |
| 4,497,196 | 2/1985 | Bakermans et al. | 72/405 |
| 4,693,109 | 9/1987 | Connor et al. | 72/344 |

FOREIGN PATENT DOCUMENTS

| | | | |
|---|---|---|---|
| 0116447 | 2/1984 | European Pat. Off. . | |
| 245931 | 11/1986 | Japan | 72/407 |
| 2064402 | 6/1981 | United Kingdom . | |

*Primary Examiner*—David Jones

*Attorney, Agent, or Firm*—Bruce J. Wolstoncroft; Frederick W. Raring

[57] ABSTRACT

Tooling system for a forming machine has a continuous guide passageway in which first and second tooling assemblies are contained for movement towards and away from each other. The passageway has passageway surfaces which serve as bearing and guiding surfaces for the tooling assemblies. Each of the tooling assemblies has a ram member and a tool holder mounted on the ram member. Additionally, a face plate is provided on one of the tooling assemblies at the leading end thereof and is movable relative to the leading end between a retracted position and an extended position. When in its extended position, it is spaced from the ram so that tools, such as punches have their ends in openings in the face plate. When the tooling assemblies move against strip material positioned therebetween, the punches or similar tools move from the face plate and perform operations on the strip. The face plate then serves as a stripper plate during reverse movement of the ram. The pilot pins are separately actuated by an external actuator but are carried in one of the ram assemlies.

19 Claims, 9 Drawing Sheets

TOOLING FOR FORMING MACHINES HAVING IMPROVED GUIDANCE, TOOL MOUNTING, AND PILOT PIN SYSTEMS

FIELD OF THE INVENTION

The invention relates to mounting and guiding systems for tools, such as punches and dies, for performing operations on strip material. The disclosed embodiment of the invention is particularly intended for use with machines of the general type shown in U.S. Pat. No. 4,497,196.

BACKGROUND OF THE INVENTION.

U.S. Pat. No. 4,497,196 (which is hereby incorporated by reference in its entirety) describes a machine for performing operations on strip material which is intermittently fed therethrough. The machine shown in that U.S. patent has a plurality of individual machine modules, each of which has an associated strip feeding means and tooling members, such as punches and dies, for performing operations on the strip material. One system for mounting the tooling members is shown in the above-identified U.S. Pat. No. 4,497,196 and the present invention is directed to the achievement of an improved tool mounting system having several advantages such as the achievement of a higher degree of precision in the positioning and guidance of the tools, reduced tool wear resulting in reduced tooling maintenance, ease of changing the tooling in the system, and improved pilot pin guidance systems.

THE INVENTION

The invention comprises apparatus for performing operations, such as punching and forming operations on strip material which is intermittently fed therethrough. The apparatus comprises first and second tooling assembly which in turn comprise first and second tool holder means and first and second tooling means carried by the tool holder means. A tooling assembly actuating means is provided for reciprocating the first and second tooling assemblies towards and away from each other between an open position and a closed position, the tooling assemblies being remote from each other in their open positions and being proximate to each other in their closed positions. Guide means are provided for guiding the tooling assemblies along their paths of reciprocation, the strip material being fed along a strip feed path which extends transversely of the paths of reciprocation so that the tooling means performs operations on the strip material during each operating cycle. The apparatus is characterized in that the guide means has a continuous guide passageway extending therethrough and the first and second tooling assemblies are contained in the passageway. The passageway has passageway surfaces which serve as bearing and guiding surfaces for the tooling assemblies. Each of the tooling assemblies comprises a ram member having a leading end and a trailing end, the leading ends being opposed to each other. Each of the ram members has ram bearing surface portions which bear against the passageway surfaces. The first and second tool holder means are carried by the first and second ram members respectively at the leading ends thereof. The first tooling assembly has a face plate means thereon, the first tool holder means being between the first face plate means and the leading end of the ram. The first tooling assembly further has guide plate means thereon which precisely hold and locate the face plate means. The guide plate means extend from the face plate means towards the trailing end of the first ram, past the first tool holder means, and at least partially over the surface of the first ram so that portions of the guide plate means are between the first ram and the passageway surfaces. The guide plate means have guide plate bearing surface portions which bear against the passageway surfaces whereby the face plate means, the guide plate means, the tool holder means, and the rams are all located in the apparatus by the passageway surfaces and the tooling assemblies are guided along their paths of reciprocation by the passageway surfaces.

In a preferred embodiment, the face plate means is movable between a retracted position and an extended position, the face plate means being substantially against the first tool holder means when it is in its retracted position and is spaced from the first tool holder means when it is in its extended position. The guide plate means is secured to and movable with the face plate means between the retracted and extended positions.

In the preferred embodiment, the passageway and ram members have rectangular cross sections and the guide plate means comprise flat plates which are slidably carried on the first ram member.

In accordance with further aspects of the invention, the face plate means has tool-receiving openings extending therethrough which are parallel to the axis of the passageway and the first tooling means comprises rod-like tooling members such as punches. The tooling members have free ends which are normally within the openings in the face plate means and are precisely positioned therein so that they are guided by the face plate means and protected by the face plate means. In accordance with this aspect of the invention, the tooling members may be only relatively loosely supported in the first tool holder means, the face plate means being relied upon to precisely position the tooling in the operating zone of the apparatus.

In accordance with a further aspect of the invention, pilot pins are provided in the first ram which have free ends that enter pilot holes in the strip material prior to engagement of the face plate means with the strip material. The pilot pins precisely position the strip material on the strip feed path with reference to the tooling assemblies. A separate pilot pin actuating means is provided for moving the pilot pins, the pilot pin actuating means being separate from the actuating means for the tooling assemblies.

THE DRAWING FIGURES

THE DISCLOSED EMBODIMENT

Figure 10:
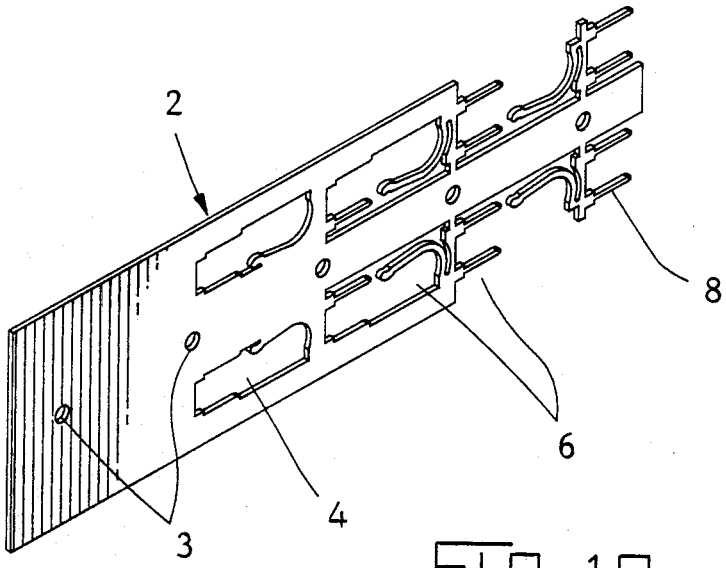
FIG. 10 is a perspective view of a short section of strip material and illustrating the steps involved in producing stamped and formed parts from the material.

FIG. 10 shows a strip 2 of sheet metal of the type used to produce stamped and formed parts, such as electrical terminals. In the production of the terminals, pilot holes as shown at 3 are first punched in the strip. These holes are engaged by a feed means to feed the material through the stamping and forming machine and are also engaged by pilot pins as will be described below to position the material in each of the stations of the machine. Initially, the blanks for the parts 8 are produced by stamping holes in the strip as shown at 4. Thereafter, the strip is fed through several stages as shown at 6 until the finished devices 8 are produced. The embodiment of the invention disclosed herein has punches and dies for producing holes, in other words for carrying out the initial steps in producing the blanks for the finished parts 8. The subsequent stamping and forming steps would be carried out in similar stations which would have the appropriate tooling for the particular operation being carried out.

Figure 1:
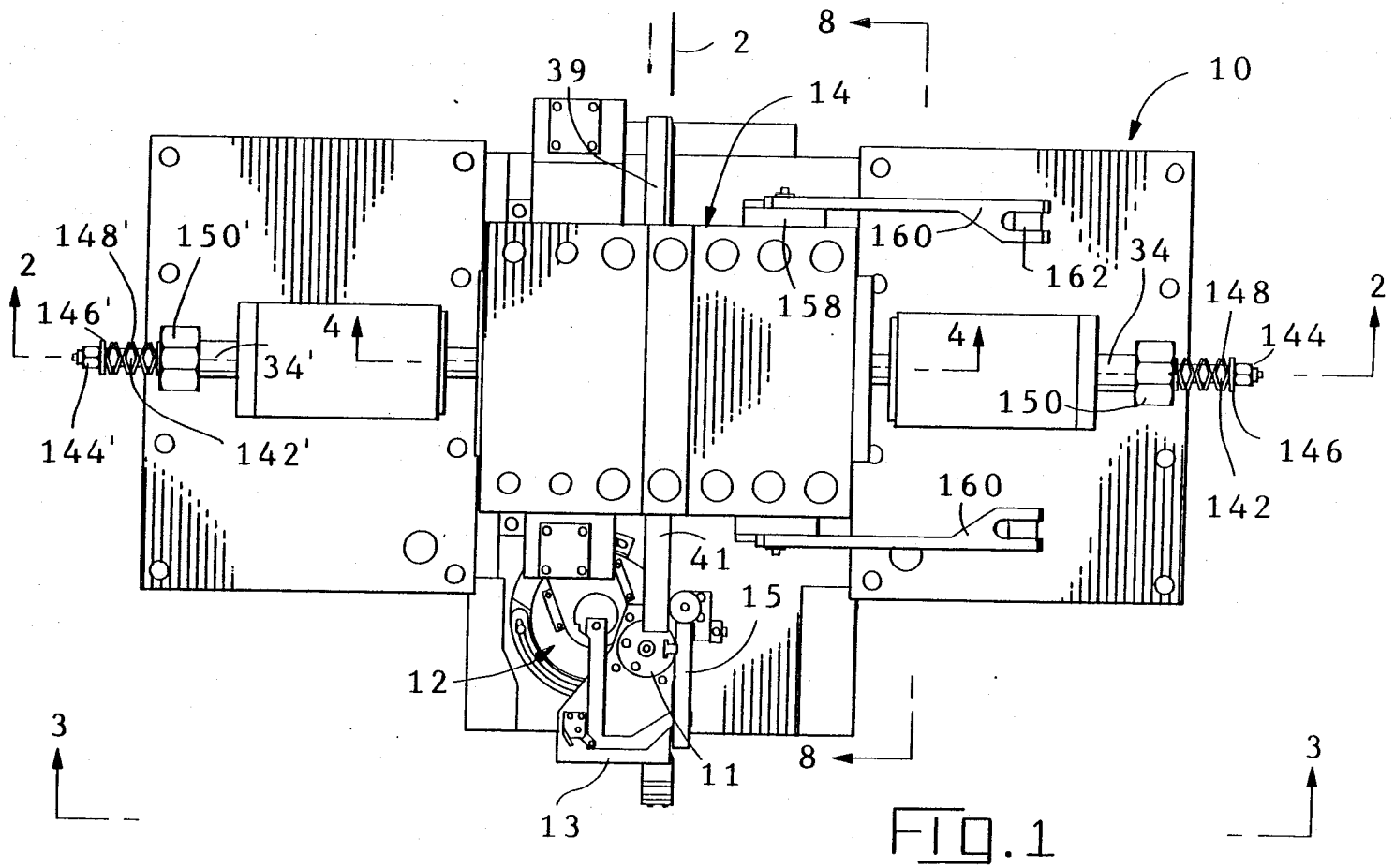
FIG. 1 is a top plan view of a machine module which incorporates a tool mounting and pilot pin system in accordance with the invention.
Figure 2:
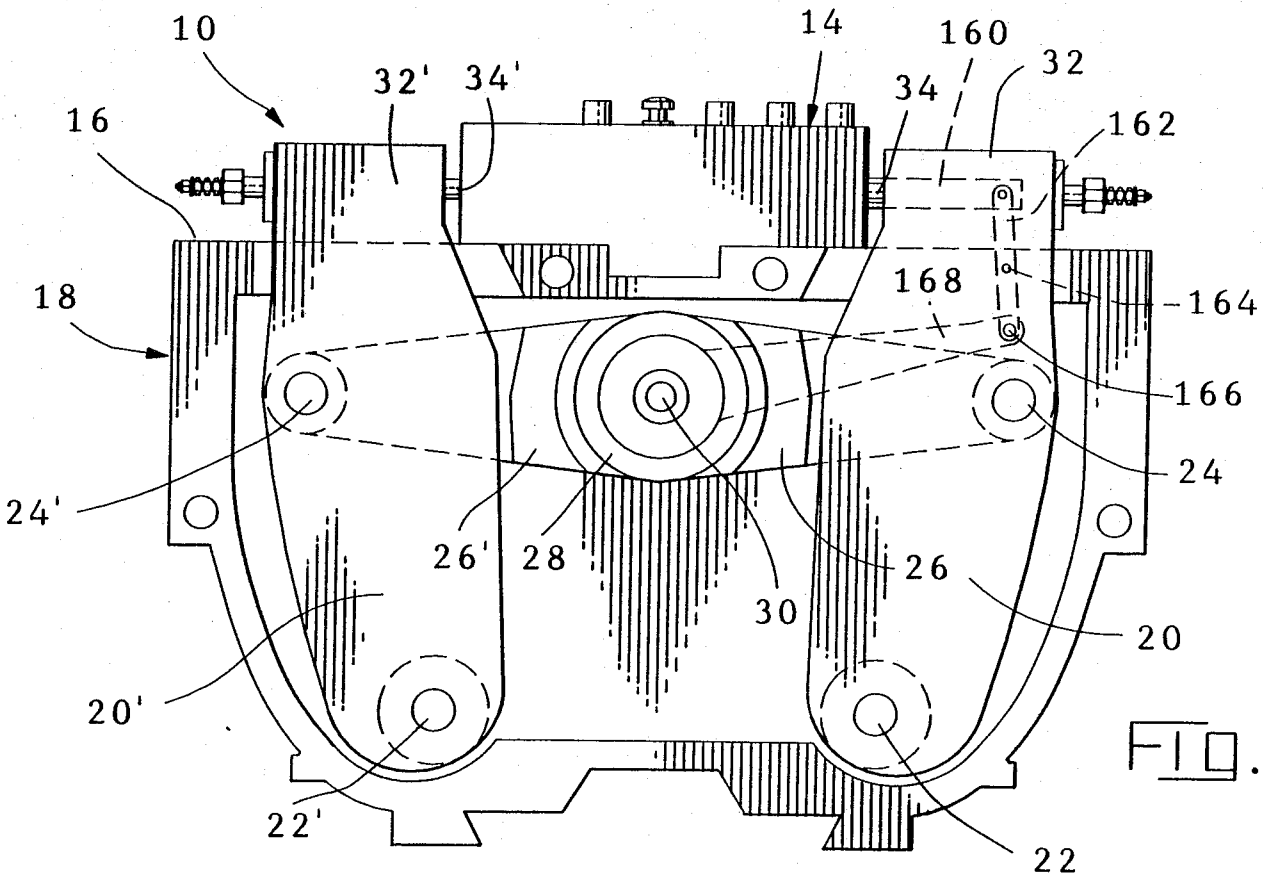
FIG. 2 is a cross-sectional view, looking in the directions of the arrows 2—2 of FIG. 1, of the machine module.
Figure 3:
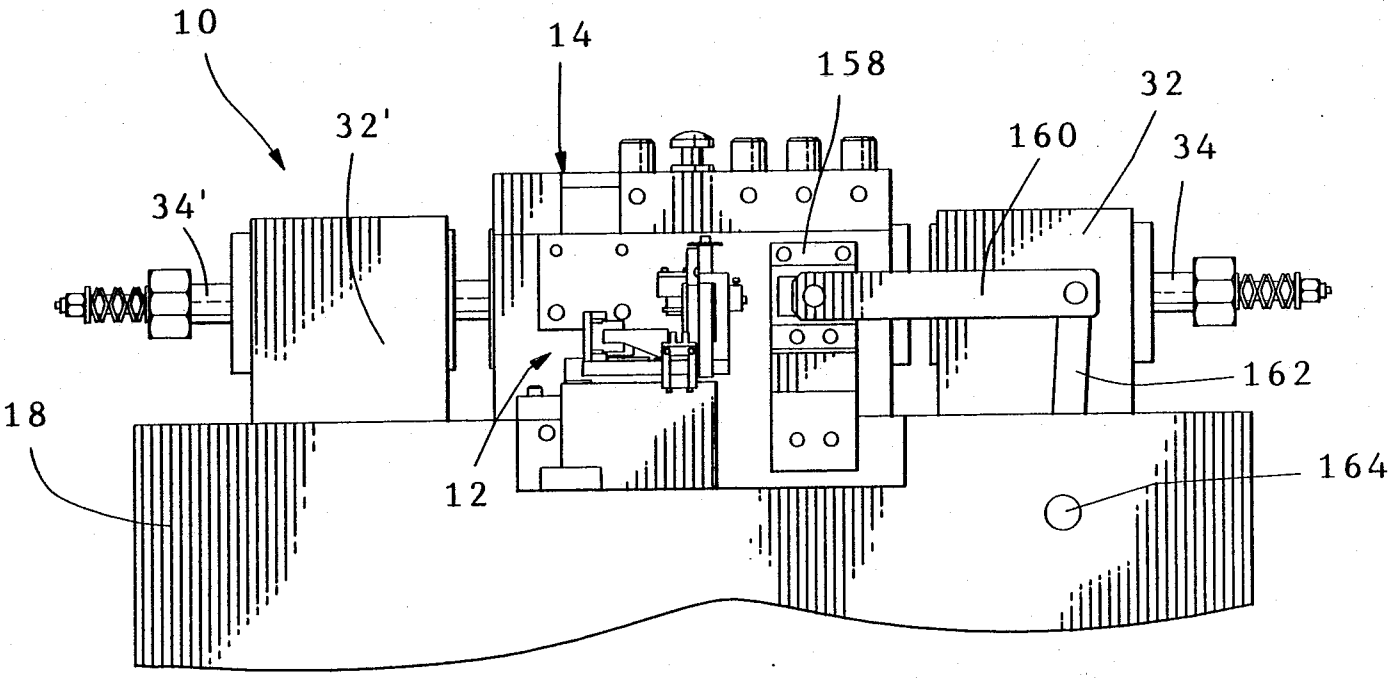
FIG. 3 is a side view looking in the direction of the arrows 3—3 of FIG. 1 and showing the tooling system of the invention and the pilot pin actuating means.

FIGS. 1–3 show a machine module 10 of the general type described fully in U.S. Pat. No. 4,497,196 which incorporates a tooling system in accordance with the present invention. The module as a whole will be described only briefly since the present invention is concerned with the tool mounting system and the pilot pins.

The module comprises a module housing 18 having a top surface 16 on which the die module housing 14 of the invention is mounted. A strip feed mechanism 12 is provided on the top of the machine module which may be of the type described in U.S. application Ser. No. 057,557, filed June 3, 1987. (Docket 13974). In general, this strip feeding mechanism comprises an intermittently rotated feed wheel 11 which is engaged with the strip 2 during feeding intervals by a strip guide member 15 under the control of a bell crank mechanism as shown at 13. The strip 2 is fed in the direction of the arrow in FIG. 2 through the die module housing 14 by the feed mechanism 12.

As shown in FIG. 2, the housing 18 is substantially symmetrical about its vertical center line and has on each side of this center line, actuator levers 20, 20′ which are pivoted at their lower ends 22, 22′. Intermediate their ends, these levers 20, 20′ are pivoted at 24, 24′ to links 26, 26′ which in turn have eccentric couplings 28 with a power shaft 30. The power shaft rotates continuously so that the levers 20, 20′ are oscillated continuously. The upper ends 32, 32′ of the levers have thrust members 34, 34′ thereon which transmit the thrust or force from the levers 20, 20′ to the tooling assemblies which will be described below.

Figure 8:
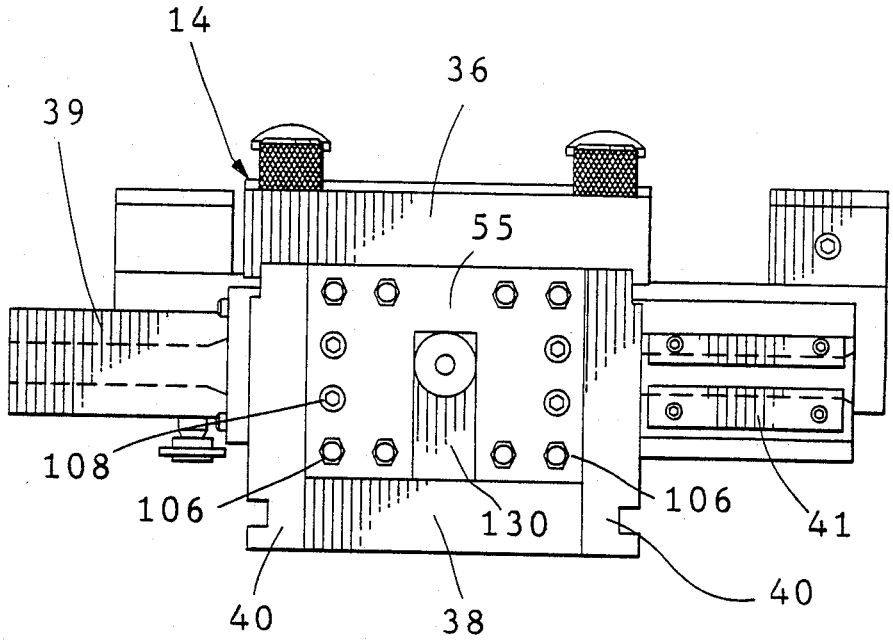
FIG. 8 is an end view looking in the direction of the arrows 8—8 of FIG. 1.

The die assembly module housing 14 has, as shown in FIG. 8, upper and lower housing plate members 36, 38 and housing side plates 40, these plates being bolted to each other by suitable fasteners as shown. The strip material is guided by strip guides 39, 41 through suitable openings in the side plates 40. The upper and lower plates and the side plates define an internal guide passageway 42 which has continuous surfaces which serve as guide surfaces for first and second tooling assemblies 44, 46, see FIG. 4. The tooling assemblies are reciprocable in the passageway 42 between open positions in which they are relatively remote from each other and closed positions in which they are proximate to each other. As the tooling assemblies moved from their open to their closed positions, the operations performed on the strip material are carried as will be described below.

The first tooling assembly comprises a ram assembly 48 and a face plate assembly 82 which is in front of the ram assembly. The ram assembly, FIGS. 5 and 7, comprises a ram block 49, a spacer plate 50, a tool holder plate 52, a tooling retainer plate 54, and a back plate 55. The ram block 49 has a leading end 56, and a trailing end 58, the back plate being secured to the trailing end by fasteners 108 (see FIG. 4). The ram block has oppositely-facing side surfaces 60 and upper and lower surfaces 62, 64. The surfaces 62 are recessed adjacent to the leading end of the ram block as shown at 66 and the side surfaces are similarly recessed as shown at 68. Projections are provided in these recessed areas as shown at 70 and 72 and the surfaces of these projections serve as bearing surfaces as will be described below.

The tooling members carried by the first tooling assembly 44 are punches 74 for punching openings in the strip material and are cooperable with die openings in the second tooling assembly. The tool holder 52 has openings 76 therein which receive the punches and the punches extend from the tool holder through openings 78 in the retainer plate 54. The spacer plate 50 is interposed between the heads of the punches 74 and the leading end 56 of the ram block 49 and this spacer plate is advantageously of a hardened material which is capable of withstanding the localized compressive forces imposed by the punches when the machine is operating.

The retainer plate 54 is held against the tool holder plate by relatively long screws 80 which extend through openings in the ram block 49 from the trailing end thereof and which are threaded into the retainer plate 54. The retainer plate thus functions to clamp the tool holder plate 52 and the spacer 50 against the leading end of the ram block.

The face plate assembly 82 (FIG. 6) comprises the face plate 84 and a relatively thicker support plate 86 which is behind the face plate. The support plate is secured to the face plate 84 and precisely aligned therewith by fasteners 88 and dowel pins 89. Holes 90 are provided in the face plate for the leading ends of the punches and aligned holes are provided in the support plate 86. When the first tooling assembly is in its retracted positions, (FIG. 4) the free ends or outer ends of the punches are recessed in the face plate 84 and are protected thereby. When the face plate engages the strip material 2 and during movement of the first tooling assembly to its closed position, the punches move from these openings 90 and through the strip and into die openings in a die plate 172 described below.

It should be noted at this point that the openings 90 in the face plate, and the openings 92 in the support plate are precisely formed so that the leading ends of the punches are precisely held and guided during the punching operation. It is not essential that the head portions of the punches be precisely mounted in the tool holder plate 52 and in fact, it is somewhat advantageous to mount the punches rather loosely in this tool holder plate. A highly desirable feature of the invention, however, is that the punches are precisely confined and controlled at their leading ends and are not subjected to lateral stresses in their shank portions when they are engaged in punching the holes in the strip material, that is, at the time of highest stress. These holes, in the face plate particularly, are advantageously formed by the most precise machining methods available, particularly wire EDM methods, for maximum precision and the tolerances between the punch dimensions and the hole dimensions in the face plate are extremely tight. Typically the punches will be only 0.0002 inches narrower on each side than the holes in the die plate which receive the ends of the punches.

Figure 4:
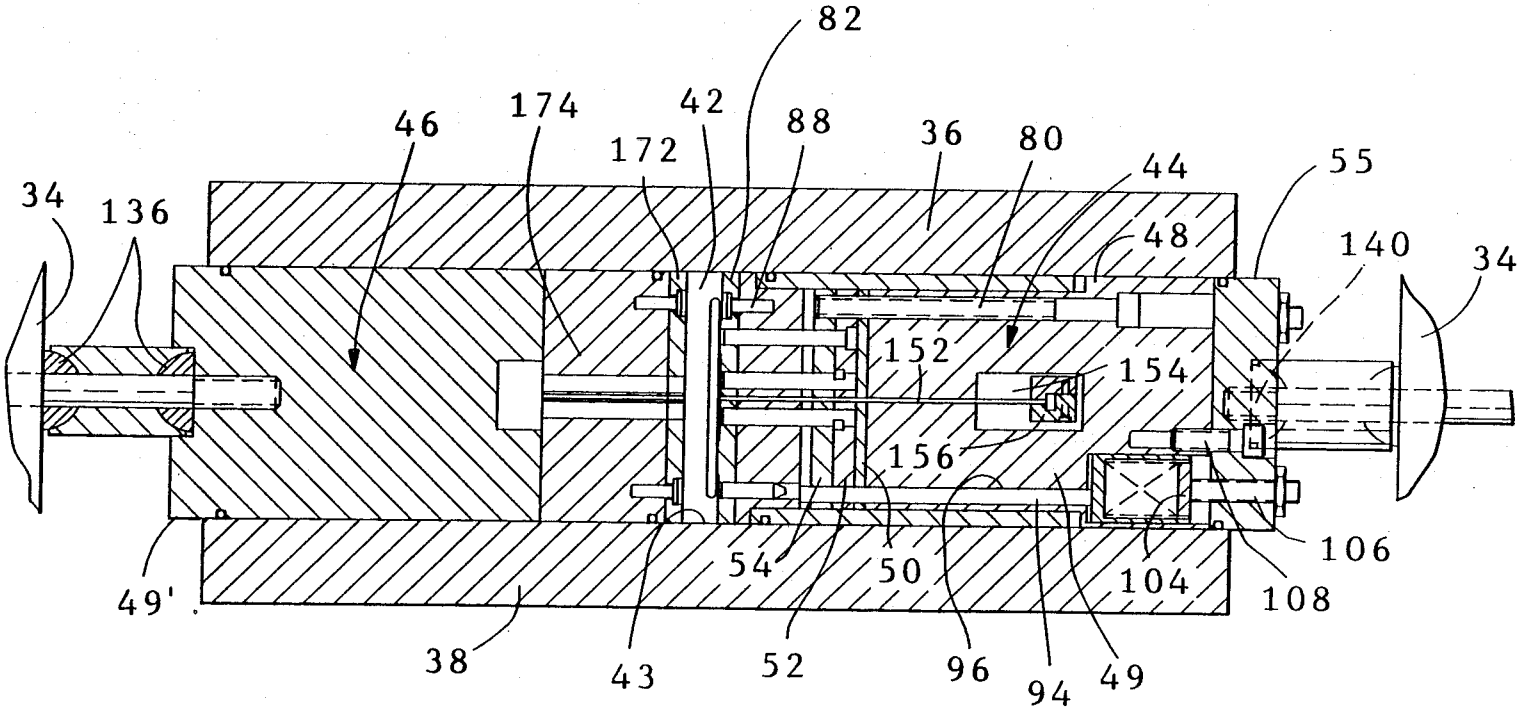
FIG. 4 is a cross-sectional view looking in the directions of the arrows 4—4 of FIG. 1 showing the tooling assemblies in their open positions.
Figure 5:
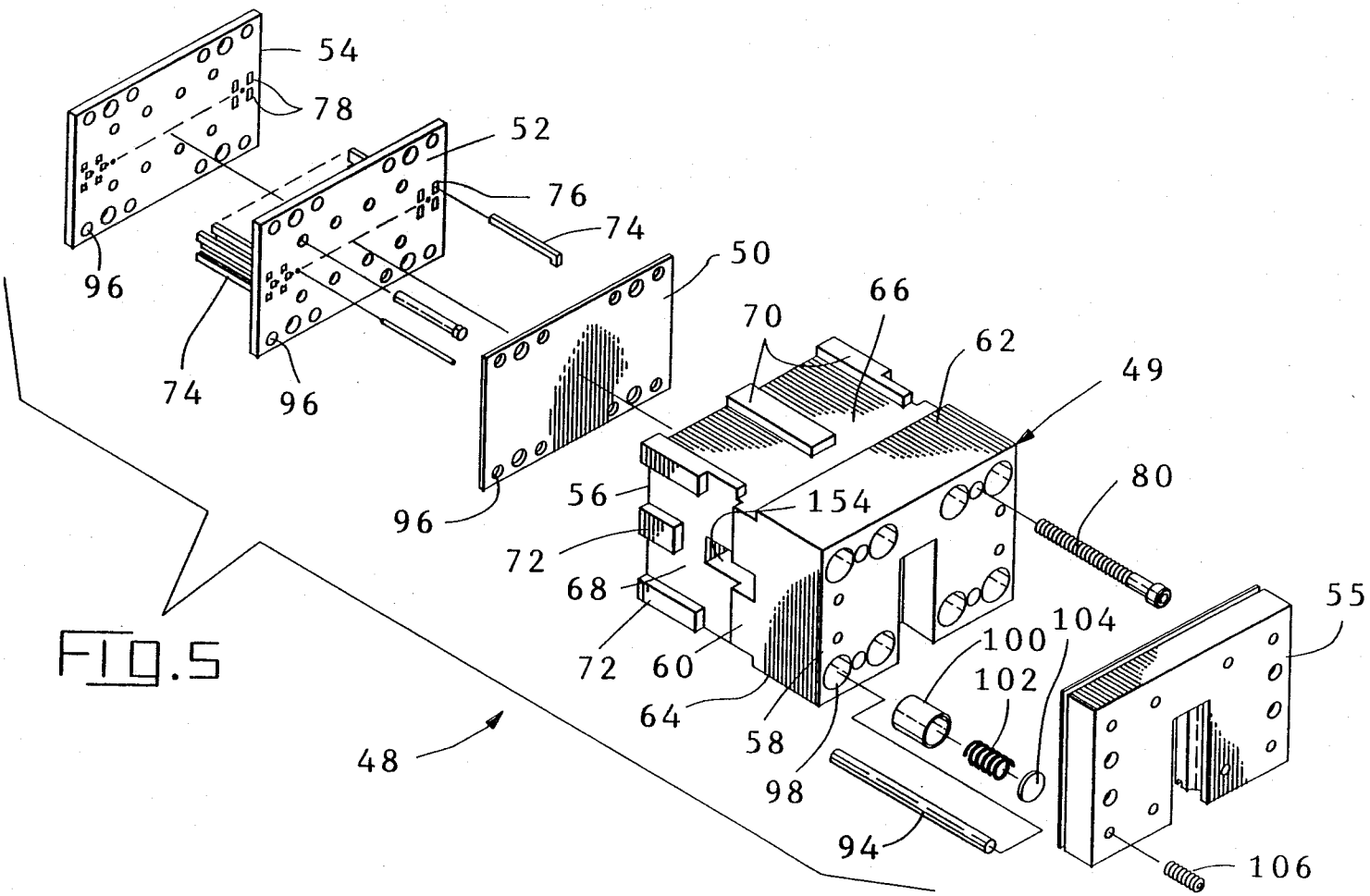
FIG. 5 is a perspective exploded view showing the ram assembly of the first tooling assembly.

The face plate assembly 82 is resiliently biased to its extended position as shown in FIG. 4 by face plate control rods 94, fur such rods being provided in the disclosed embodiment adjacent to the corners of the tooling assembly. Each of the rods extends through an elongated hole in the ram block and through aligned holes 96 in the spacer 50, the tool holder 52, and in the clamping block 54. The ends of these holes adjacent to the trailing end of the ram block are counterbored as shown at 98 and a cylindrical liner 100 is provided in the counterbore. This member 100 is internally hollow but has an inner end as shown and a spring 102 is mounted in this liner 100. The open right-hand end as viewed in FIG. 4 of the member 100 is closed by a disk 104 which bears against and confines the spring 102. A screw 106 in turn is threaded through the back plate 55 and bears against the disk.

It will be apparent that the leading ends of the rods 94 will bear against the rightwardly facing surface of the face plate support member 86 and thereby bias it to its extended position. The entire face plate assembly can, however, move rightwardly a slight distance relative to the ram assembly to close the slight gap which is shown in FIG. 4 between the clamping plate 54 and the surface of the support plate 86.

Figure 6:
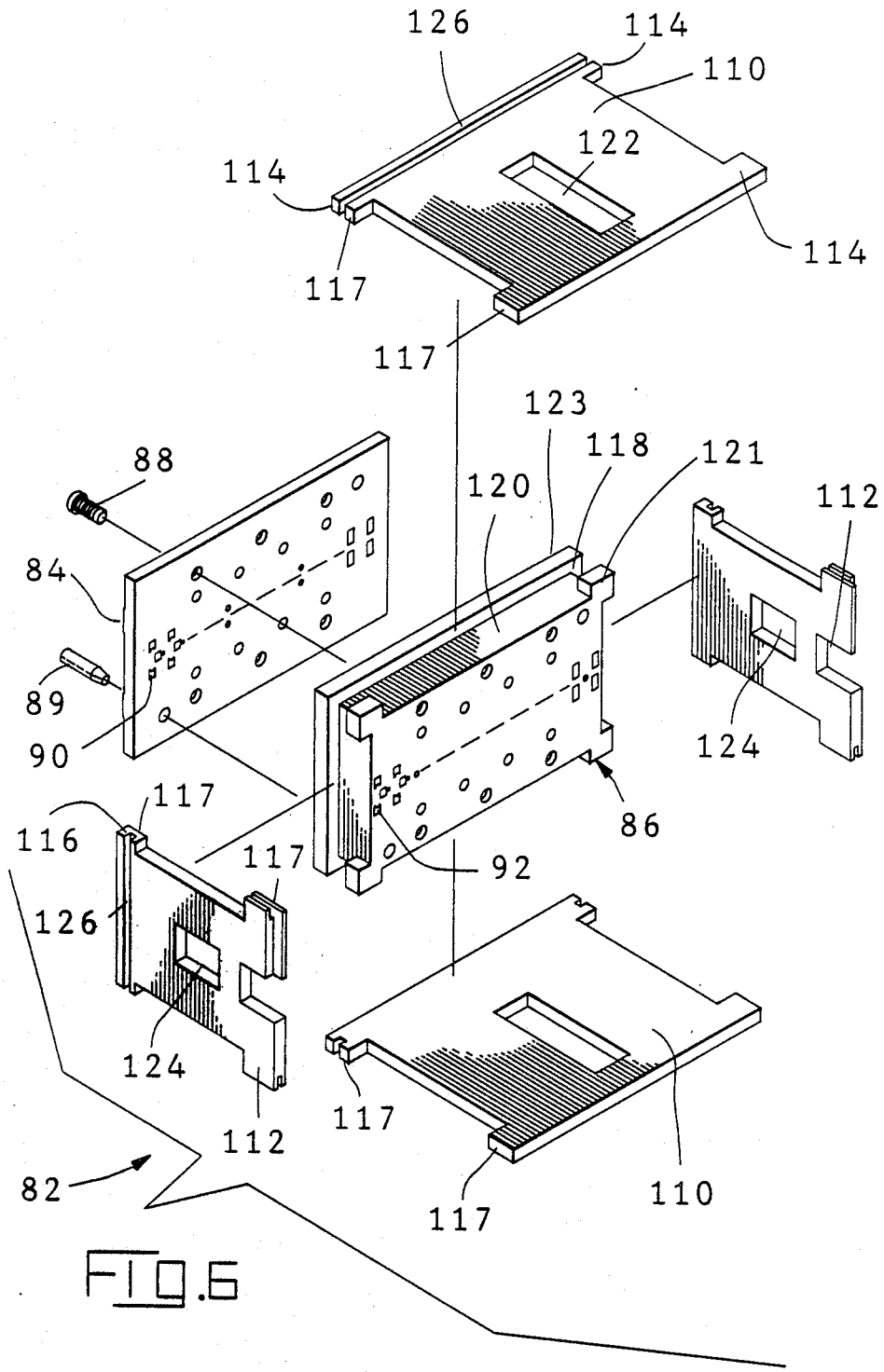
FIG. 6 is a perspective exploded view showing the face plate means and the guide plates which are associated with the face plate means.

As shown in FIGS. 4 and 6, the face plate assembly 82 comprises, in addition to the face plate 84 and the support plate 86, top and bottom plates 110 and side plates 112. These top, bottom, and side plates are secured to the support plate 86 and extend rightwardly, as viewed in FIG. 4, towards the trailing end of the ram block 49 and partially over the inner surfaces of the ram block. The surfaces of the plates 110, 112 are thus between the recessed surfaces 66, 68 of the ram body and the internal guiding surfaces 43 of the passageway 42. The plates thus provide extended bearing surfaces which are cooperable with the surfaces 43.

The precise guidance and alignment of the face plate assembly is achieved by the edge surfaces shown at 117 on the ears 116 of the top and bottom plates and the side plates 112. The fact that guiding and bearing surfaces are provided at the leading ends and at the trailing ends of the plates minimizes any tendency of the assembly to rock or wobble in the passageway.

The plates 110, 112 have ears 114, 116 at their corners and these ears, in turn, interlock with the support plate 86. The support plate has an inwardly stepped edge surface 120 and ears 121 are provided on the support plate 86 at the corners thereof so that recesses 118 are provided at each corner between the ears 121 and the left-hand portion 123 of the support plate 86. The ears 114, 116 extend into these recesses and the plates 110, 112 are thereby interlocked with the support plate and are precisely positioned relative thereto.

The plates 110 have rectangular openings 122 for reception of the centrally located projections or islands 70 on the surface 66 of the ram body. The side plates 112 have similar rectangular openings 124 for the central projections 72. In addition, the edges of the plates 110, 112 are contoured to receive the projections as shown at 70, 72 on the corners of the ram block 49. The arrangement is such that the plates can move relative to the ram block 49 on the surfaces 66, 68, thereby to permit movement of the face plate assembly 82 between its extended and retracted positions.

The plates 110, 112 have shallow grooves 126 extending thereacross adjacent to the left-hand ends of these plates as viewed in FIG. 6. These grooves are lined with felt wicks and provided in order to facilitate the lubrication of the tooling assembly. In addition, it is desirable to provide very shallow crisscrossed grooves to facilitate lubrication on the surfaces of the plates 110, 112 (not specifically shown). The high degree of precision with which the parts of the tooling assembly are manufactured and the close tolerances involved in the practice of the invention require careful attention to the lubrication of the tooling assemblies.

Figure 7:
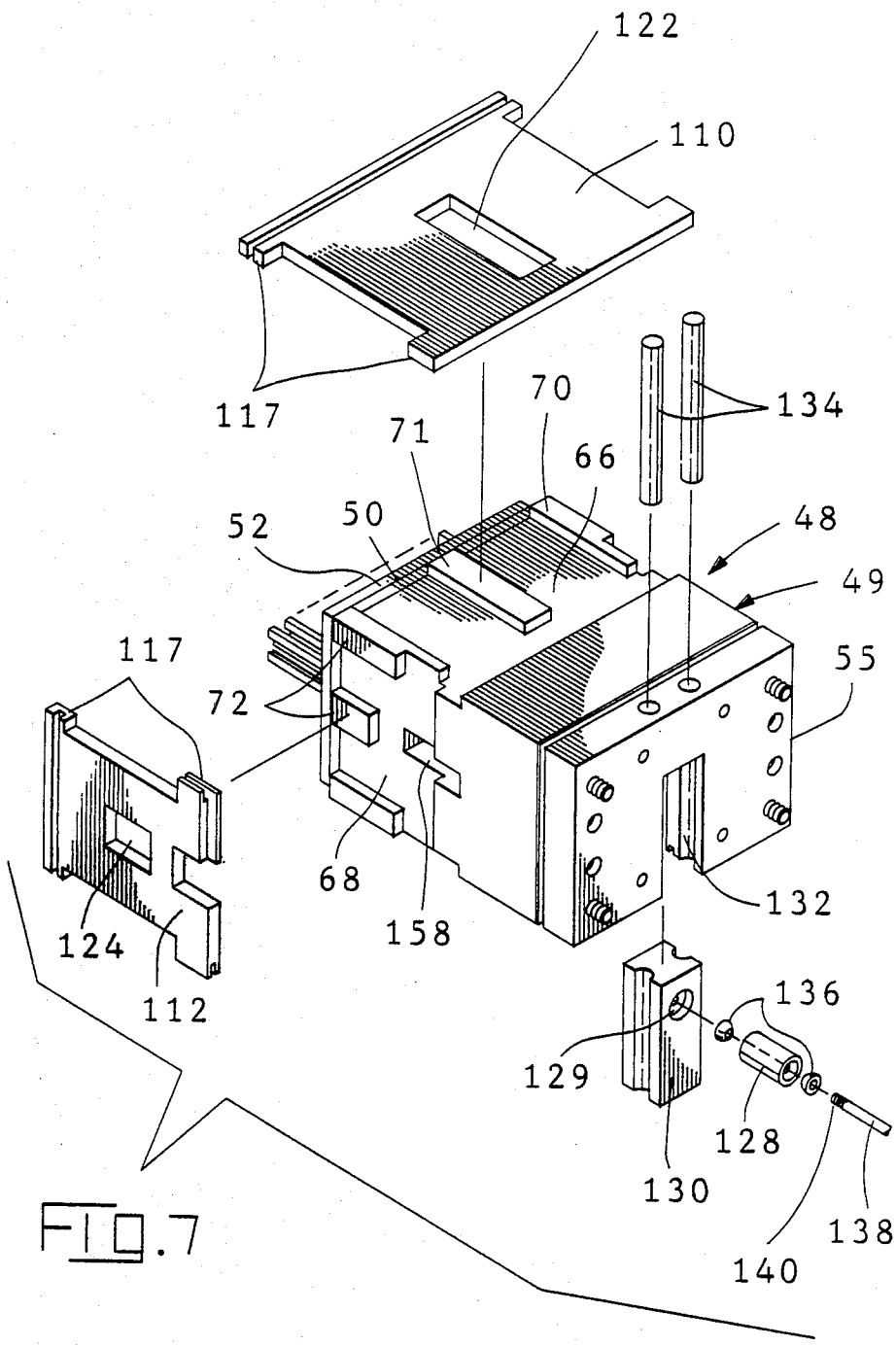
FIG. 7 is a view showing the ram assembly with the parts thereof assembled to each other and with two of the guide plates exploded from the surfaces of the ram assembly.

The first tooling assembly 44 is moved from its open position to its closed position (leftwardly as viewed in FIG. 2) by the force transmitting member 34 which extends through the upper end of the lever 20. As shown in FIGS. 4 and 7, the end of this member 34 bears against a cylindrical spacer 128 which transmits the force to the back plate 55 of the ram assembly. The force is transmitted through an insert bar 130 which is received in a recess 132 in the plate 55 and which is held therein by keys 134 Which enter grooves in the sides of the bar 130 and in the sides of the recess 132. The spacer 128 has hemispherical recesses at its ends which receive hemispherical bearings 136 so that a very slight arcuate movement can take place between the end of the force-applying member 34 and the spacer 128. The arcuate movement is extremely slight, however, it is preferable to allow very limited movement by means of these hemispherical bearings 136 to accommodate such movement. The left-hand end of the spacer 128 is received in a cylindrical recess 129 in the insert 130 as shown best in FIG. 7.

In order to return the first tooling assembly, that is to move it from its closed position to its open position, a cable 138 is provided which has a fitting or adaptor 140 on its end. The adaptor and cable extend through aligned openings in the spacer 128 and in the bearings 136. The threaded end of the adaptor is threaded into an opening in the insert 130. The cable 138 extends through an axial bore in the thrust member 34 and through a guide tube on the right-hand end of the thrust member as viewed in FIG. 1. The right-hand end of the cable is held by a locknut 144 against a washer 146 and spring means 142 are provided between this washer and another washer which is located against a nut 150 on the end of the member 34. It will thus be apparent that when the upper end of the lever 20 swings rightwardly, it will carry with it the nut 150 and, acting through the springs 142, move the cable 138 rightwardly to thereby retract the first tooling assembly and move it from its closed position to its open position.

It should be noted that the force which moves the tooling assembly to its closed position for the working stroke is transmitted through the insert 130 to the ram block and by-passes the keys 134. The force which returns the tooling assembly to its open position is transmitted through the keys 134, but this is an extremely low force as compared to the force required for the working stroke.

The actuating means for the second tooling assembly 46 is substantially the same as that described above and the corresponding structural parts are identified by the same reference numerals, differentiated in FIG. 1 by prime marks.

It is desirable in all stamping and forming dies to provide pilot pins which enter the strip being formed prior to engagement of the tooling, such as the punches and other tooling, with the strip thereby precisely to position the strip with reference to the tooling. The use of pilot pins is particularly important where parts such as electrical terminals are produced by progressive operations on the strip since the partially formed parts on the strip must be located precisely relative to the tooling which performs subsequent operations. Pilot pins as shown at 152 (FIG. 4) are accordingly provided in the instant apparatus and are of particular importance because of the high degree of precision required in positioning the strip material. The pilot pins 152 have leading ends which are normally located in openings in the face plate 82 and which move beyond the face plate and into the pilot holes 3 of the strip prior to engagement of the punches with the strip. The pilot pins extend through aligned openings in the support plate, the tool holder plate, the clamping plate, and the spacer and through openings also in the ram block. The right-hand ends of these pilot pins extend into an opening 154 which extends transversely through the ram block. The right-hand ends of the pilot pins are secured to a pilot yoke 156 which is movable in the opening 154 and which has ends which extend laterally beyond the housing side plates 40. The ends of the yoke have rollers thereon which are received in guideways 158 on the side plates 40. The bearings are pivotally connected to links 160 which extend as shown in FIG. 3 to actuator levers 162 on each side of the upper end of the lever 20. The levers 162 function as actuator levers for the links 160 and therefore for the pilot pins. The actuator levers 162 are pivoted as shown at 164 (FIG. 2) and at their lower ends are pivotally connected at 166 to an arm 168 on an eccentric (not shown) which is mounted on the main power shaft 30. The eccentric is designed to cause oscillation of the linkage 166 and the actuator lever 162 such that the pilot pins will enter the pilot holes in the strip at the appropriate time in the operating cycle as will be explained below.

It will be apparent from the foregoing description that the pilot pins have their own actuating means which is separate from the actuating means for the first tooling assembly. As will be explained below, the movements of the pilot pins can therefore be controlled in a manner which is totally independent of the actuating system for the tooling assembly and this provides distinct advantages as will be explained in the discussion of the timing diagram, FIG. 9.

The second tooling assembly 46 which is on the left in FIG. 4, is relatively simple in that it merely comprises a ram block 49', a spacer plate 174, and a die plate 172 which is secured to the spacer plate by fasteners as shown. The die plate has openings therein which receive the leading or outer ends of the punches. Because of the fact that the spacer plate is relatively long, as measured in the direction of the horizontal axis of the passageway 42, and because of the fact that this spacer plate and the die plate 172 provide extensive bearing surface for bearing against the internal surfaces 43 of the passageway, it is unnecessary to provide guide plates as are required on the first tooling assembly. Accordingly, the second tooling assembly need not be described in further detail. It should be mentioned that if desired, movable tooling can also be provided on the second tooling assembly 46 and for some forming operations, such movable tooling may be used. In other words, the second tooling assembly 46 may, in some embodiments, have all of the features of the first tooling assembly 44.

Figure 9:
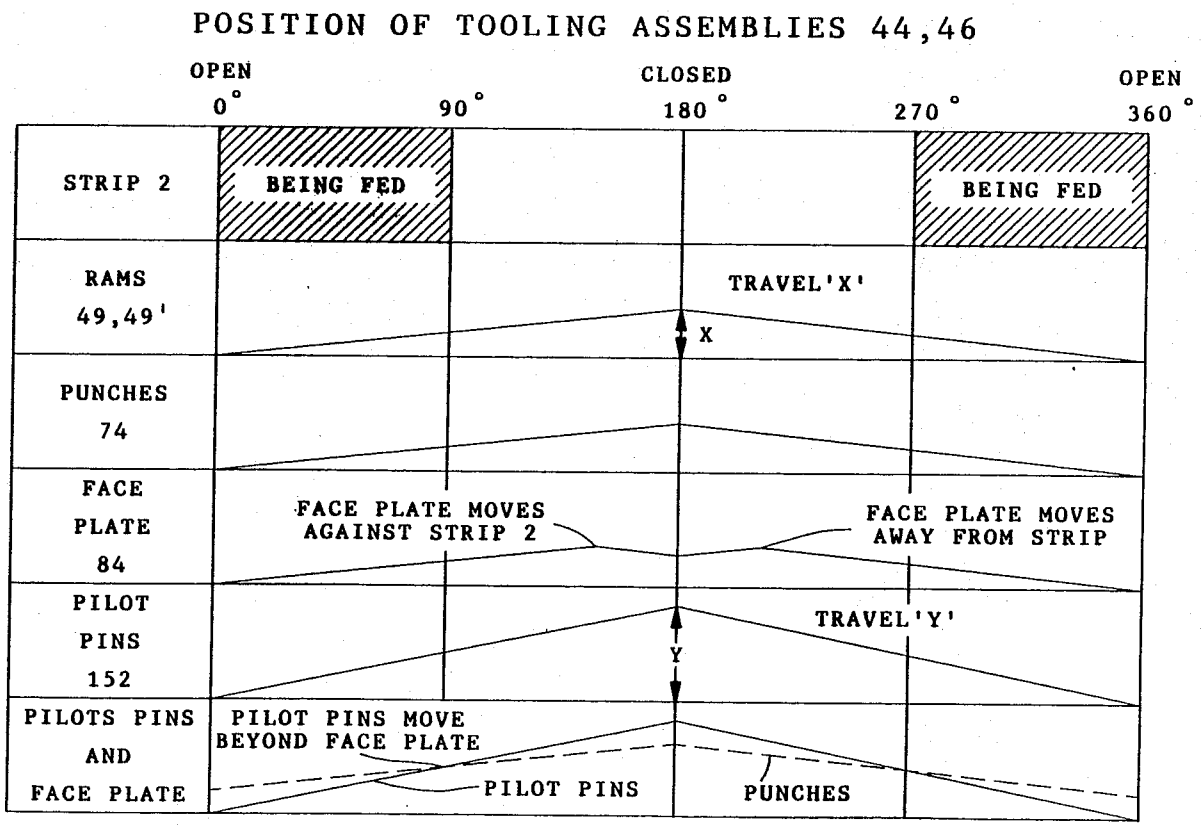
FIG. 9 is a timing diagram which describes the movements of the parts of the apparatus.

The operating cycle of the die system in accordance with the invention can be best understood from a study of FIG. 9 which illustrates the movements of the principal parts with reference to the movement of the tooling assemblies from their open position to their closed positions and back to their open positions. The closed positions are at 180 degrees as indicated and the open positions are at 0 degrees. The strip material is fed by the strip feeding means during the first 90 degrees of the operating cycle and during the last 90 degrees, the feeding operation continuing through the open positions at 0 degrees or 360 degrees. The ram assemblies move from their open positions to their closed positions and the actual amount of travel indicated as X is shown to scale relative to the travel of the pilot pins. The travel of the punches is, of course, the same as the travel of the ram since the punches are carried directly on the ram. The face plate engages the strip material in advance of the leading ends of the punches and in fact, the face plate retracts a very slight distance when it first engages the strip as shown in the portion of this diagram in the vicinity of 180 degrees. The pilot pins move in synchronism with the tooling assemblies but are separately actuated as described above and in the embodiment shown, the travel of the pilot pins indicated by the distance Y, is much greater than the travel of the tooling assemblies or the punches. These differences in the travel are shown graphically in the lower most line of the diagram in which the pilot pin travel and the punch travels are superimposed on each other.

It will be apparent from the foregoing that numerous advantages can be realized from the practice of the invention as compared with stamping and forming die systems which are conventionally used. Such systems commonly are built around a so-called die set having upper and lower plate-like die shoes which are guided towards and away form each other by post and bushing systems. Ordinarily, the punches or other tooling are mounted in the upper die shoe and the dies are mounted in the lower die shoe. The guidance system comprises posts on one of the die shoes and bushings on the other die shoes. This means that the punches on the lower die shoe are located with reference to the posts (assuming that the posts extend from the lower die shoe) while the punches are located on the upper die shoe with reference to the bushings. This guidance system immediately introduces possible errors and limits the precision of the operation since two different elements (the posts and the bushings) are used to locate the punches and the dies.

A further feature of a conventional die system which limits the dimensional precision of the parts produced is the stripper plate in those systems. A stripper plate is frequently required in a die set in order to remove the strip material from the punches when the punches are moved away from the strip after the holes in the strip are punched. The punches will have a tight fit in the holes which have been punched and the punches tend to drag the strip along when they move to their open positions. The stripper plate engages the strip and restrains it from movement with the punches so that the punches will move out of the holes in the strip. In a conventional die system, a separate aligning and guiding system must be provided for the stripper plate, that is a guiding system in addition to the post and bushing system described above. In the practice of the present invention, the face plate, which functions as a stripper plate, is guided by the surfaces of the passageway, in other words, by the same guidance system as that used for the punches and dies.

In accordance with the present invention, one continuous guidance surface, the surface 43 of the passageway 42 is relied upon to guide all of the elements of the two tooling assemblies 44, 46. In addition, the face plate assembly has relatively long bearing surface portions on the guide plates which bear against the passageway surfaces 43. The overall result is that an extremely high degree of precision can be achieved in performing the operations on the strip.

It is also particularly important that the ends of the punches are recessed in the face plate and are guided towards the dies in the die plate 172 by this face plate. This feature of the invention results in extremely close control over the leading ends of the punches and permits greater precision in the manufactured parts and greatly extended tool life since the punches do not become dull as quickly as is common practice. As also explained, the pilot pins are separately actuated and the die designer is thus free to have these pilot pins enter the strip at any desired time in the operating cycle.

The face plate functions as a stripper plate but has not been denominated as such for the reason that it also serves as a guide plate for the leading ends of the punches.

The pilot pin system described above can be used under a variety of circumstances and is particularly advantageous in machines of the type shown in U.S. Pat. No. 4,497,196 and briefly described above. Machines of this type have a very short stroke as compared to conventional stamping and forming presses. For example, a conventional stamping press will have a stroke of 0.75" to 1.00" (or more) while a machine of the type shown in the above-identified patent will typically have a stroke of 0.050" to 0.100" per side (i.e. for each tooling assembly). The extremely short stroke is highly desirable for many reasons including energy savings and greatly reduced tool wear. However, the pilot pins must have a stroke which is greater than the extremely short stroke of the tooling assemblies if the pins are to enter the pilot holes in the strip prior to engagement of the tooling with the strip. The pilot pin arrangement of the present invention completely obviates any problems which might arise from this source and, moreover, provides precise control of the pilot pins.

I claim:

1. Apparatus for performing operations, such as punching and forming operations, on strip material, the apparatus comprising first and second tooling assemblies which comprise first and second tool holder means and first and second tooling means carried by the first and second tool holder means, tooling assembly actuating means for reciprocating the first and second tooling assemblies towards and away from each other between an open position and a closed position, the tooling assemblies being remote from each other in their open positions and being proximate to each other in their closed positions, guide means for guiding the tooling assemblies along their paths of reciprocation, the strip material being fed along a strip feed path which extends transversely of the paths of reciprocation so that the tooling means performs operations on the strip material, the apparatus being characterized in that:

the guide means has a continuous passageway extending therethrough, the first and second tooling assemblies being in the passageway, the passageway having passageway surfaces which serve as bearing and guiding surfaces for the tooling assemblies, each of the tooling assemblies comprises a ram member having a leading end and a trailing end, the leading ends being opposed to each other, each of the ram members having ram bearing surface portions which bear against the passageway surfaces, the first and second tool holder means are carried by the first and second ram members on the leading ends thereof, the first tooling assembly having a face plate means thereon, the first tool holder means being between the face plate means and the leading end of the first ram, the first tooling assembly has guide plate means thereon, the face plate means being precisely held by the guide plate means, the guide plate means extending from the face plate means towards the trailing end of the first ram past the first tool holder means and at least partially over the surface of the first ram, portions of the guide plate means being between the first ram and the passageway surfaces, the guide plate means having guide plate bearing surface portions which bear against the passageway surfaces whereby, the face plate means, the guide plate means, the tool holder means and the rams are all located in the apparatus by the passageway surfaces and the tooling assemblies are guided along their paths of reciprocation by the passageway surfaces.

2. Apparatus as set forth in claim 1 characterized in that the face plate means and the guide plate means are movable as a unit on, and relative to, the first ram so that the face plate means can be moved relatively towards and away from the leading end of the first ram thereby to perform a stripping function.

3. Apparatus as set forth in claim 1 characterized in that the face plate means is movable between a retracted position and an extended position, the face plate means being substantially against the first tool holder means when it is in its retracted position and being spaced from the first tool holder means when it is in its extended position, the guide plate means being movable with the face plate means.

4. Apparatus as set forth in claim 3 characterized in that the guide plate means has openings therein, the first ram bearing surface portions being received in the openings.

5. Apparatus as set forth in claim 4 characterized in that the guide passageway and the ram members have rectangular cross sections, the guide plate means comprising flat plates which are slidably carried on the first cam member.

6. Apparatus as set forth in claim 3 characterized in that the face plate means has tool receiving openings extending therethrough parallel to the axis of the passageway, the first tooling means comprising rod-like tooling members, the tooling members extending from the first tool holder means into the openings, the tooling members having free ends which are within the openings when the face plate means is in its extended position and the tooling assemblies are in their open positions, the tooling members being movable relatively through the openings during movement of the tooling assemblies from their open positions to their closed positions with accompanying movement of the face plate means from its extended position to its retraced position whereby the free ends of the tooling members move out of the openings and engage the strip material.

7. Apparatus as set forth in claim 6 characterized in that the tooling members are punches.

8. Apparatus as set forth in claim 6 characterized in that the tooling members are precisely guided and located by the openings.

9. Apparatus as set forth in claim 8 characterized in that the first tooling members are relatively loosely supported in the first tool holder.

10. Apparatus as set forth in claim 3 characterized in that the first ram member has biasing means therein which biases the face plate means to its extended position, the face plate means being movable to its retracted position against the force of the biasing means.

11. Apparatus as set forth in claim 3 characterized in that the pilot pin means are provided in the first tooling assembly, the pilot pin means having free ends which enter pilot holes in the strip material prior to engagement of the face plate means with the strip material thereby precisely to position the strip material on the strip feed path with respect to the first and second tooling assemblies.

12. Apparatus as set forth in claim 11 characterized in that a pilot pin actuating means is provided for moving the pilot pin means into the strip material during movement of the first and second tooling assemblies from their open positions to their closed positions.

13. Apparatus as set forth in claim 12 characterized in that the pilot pin actuating means is separate from the tooling assembly actuating means.

14. Apparatus as set forth in claim 13 characterized in that the first ram has a slot extending therethrough transversely of the path of reciprocation of the first ram, the pilot pin actuating means comprising an actuator bar which extends through the slot, the pilot pin means being coupled to the actuator bar, the pilot pin means extending from the actuator bar through the first ram to the leading end thereof, the actuator bar being movable in the slot relative to the first ram by an actuator bar moving means thereby to cause the pilot pin means to enter the pilot holes prior to engagement of the face plate means with the strip material.

15. Apparatus as set forth in claim 14 characterized in that the actuator bar moving means comprises lever means coupled to the actuator bar.

16. Apparatus as set forth in claim 3 characterized in that the face plate means is resiliently biased to its extended position by face plate biasing means, the face plate means being movable from its extended position to its retracted position against the force of the face plate biasing means.

17. Apparatus for performing operations, such as stamping and forming operations, on strip material, the apparatus comprising first and second tooling assemblies which comprise first and second tool holder means and first and second tooling means carried by the first and second tool holder means, tooling assembly actuating means for reciprocating the first and second tooling assemblies towards and away from each other between an open position and a closed position, the tooling assemblies being remote from each other in their open positions and being proximate to each other in their closed positions, guide means for guiding the tooling assemblies along their paths of reciprocation, the strip material being fed along a strip feed path which extends transversely of the paths of reciprocation so that the tooling means performs operations on the strip material and pilot pins are provided, the pilot pins having leading ends which enter the pilot holes in the strip material prior to engagement of the first and second tooling assemblies means with the strip material, the pilot pins being contained in, and carried by, the first tooling assembly, the apparatus being characterized in that:

pilot pin actuating means are provided for moving the pilot pins toward the strip material during movement of the tooling assemblies from their open positions to their closed positions and for withdrawing the pilot pins from the strip material during movement of the tooling assemblies from their closed positions to their open positions, the pilot pin actuating means being separate from the tooling assembly actuating means, the first tooling assembly has an opening extending therethrough transversely of the direction of reciprocation thereof and a pilot pin carrier is provided in the opening, the pilot pins having inner ends which are secured to the pilot pin carrier, the pilot pin carrier being reciprocable in the opening parallel to the directions of reciprocation of the first tooling assembly, the pilot pin carrier extends transversely from the opening and beyond the fist tooling assembly, the pilot pin actuating means being beside the first tooling assembly and being coupled to the pilot pin carrier.

18. Apparatus as set forth in claim 17 characterized in that the pilot pin carrier extends beyond, and externally of, the first tooling assembly on each side thereof, the pilot pin actuating means being coupled to each of the ends of the pilot pin carrier.

19. Apparatus as set forth in claim 18 characterized in that the pilot pin actuating means comprises links which are coupled to means for reciprocating the links.

* * * * *